US006664018B2

(12) United States Patent
Chen et al.

(10) Patent No.: US 6,664,018 B2
(45) Date of Patent: Dec. 16, 2003

(54) IN-SITU METHOD OF FORMING ZINC STEARATE DISPERSION AND USE THEREOF IN TONERS

(75) Inventors: Allan K. Chen, Oakville (CA); Tie Hwee Ng, Mississauga (CA); Lu Jiang, Oakville (CA); Kimberly D. Nosella, Mississauga (CA); Paul J. Gerroir, Oakville (CA); Michael Damato, Thornhill (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/063,428

(22) Filed: Apr. 23, 2002

(65) Prior Publication Data

US 2003/0198886 A1 Oct. 23, 2003

(51) Int. Cl.[7] ..... G03G 5/00; B01F 17/00
(52) U.S. Cl. ..... 430/137.11; 516/77
(58) Field of Search ..... 430/137.11; 516/77

(56) References Cited

U.S. PATENT DOCUMENTS 4,410,446 A 10/1983 Cheng et al.
4,478,731 A * 10/1984 Gaucher ..... 508/539
5,939,079 A 8/1999 Le Royer et al.
5,998,523 A 12/1999 Grunbauer et al.
6,162,836 A 12/2000 Kato
6,340,549 B1 1/2002 Maehata et al.

* cited by examiner

*Primary Examiner*—Mark A. Chapman
(74) *Attorney, Agent, or Firm*—Oliff & Berridge, PLC; Eugene O. Palazzo

(57) ABSTRACT

A method of forming an aqueous dispersion of particles of zinc stearate includes the steps of forming a mixture of at least one surfactant and water, heating the mixture to a temperature of from about 40° C. to less than a melting temperature of zinc stearate, adding a metal-containing stearate to the mixture under agitation, adding to the mixture a solution of a zinc salt in water, whereby upon inclusion of both the metal-containing stearate and the zinc salt in the mixture, the zinc salt reacts with the metal-containing stearate to form the particles of zinc stearate, continuing the heating and agitation following completion of the latter of the adding of the solution of zinc salt or the adding of the metal-containing stearate to continue the reaction, and cooling to obtain the aqueous dispersion of particles of zinc stearate. The method forms a stable aqueous dispersion of nanometer sized zinc stearate particles particularly useful in coating toner particles.

19 Claims, No Drawings

IN-SITU METHOD OF FORMING ZINC STEARATE DISPERSION AND USE THEREOF IN TONERS

BACKGROUND OF THE INVENTION

1. Field of Invention

The invention relates to an in-situ method of forming an aqueous zinc stearate dispersion. The aqueous dispersion of zinc stearate finds particular utility as an external additive for toner, and more specifically as an external additive to a toner particle used as a cleaning additive in a developer composition.

2. Description of Related Art

Zinc stearate (ZnSt) is a known additive in the art of toners. It is typically included as an external additive upon the surface of toner particles to impart desired characteristics to the toner. For example, zinc stearate may be present as an additive in the external additive package to provide lubricating properties. In toner, zinc stearate provides triboelectric enhancement due to its lubricating nature. In addition, zinc stearate enables higher toner charge and charge stability by increasing the number of contacts between toner and carrier particles.

Where the toner particles are formed via aqueous based processes, for example such as by the known emulsion aggregation technique, it is then necessary to incorporate the zinc stearate external additive into the toner particles in an aqueous dispersion form so as to ensure compatibility with the toner particles. Use of the aqueous dispersion of zinc stearate particles also ensures that use of harsh organic solvents that might degrade the toner particles and properties thereof can be avoided.

However, it is difficult to obtain stable aqueous dispersions of zinc stearate particles. For example, if a commercially available zinc stearate particle is simply mixed with surfactant and water, although a dispersion may result for some amount of time, it will settle quickly and thus is not stable. Commercially available zinc stearate particles have particle sizes of between 20 microns and 50 microns that makes it difficult to form a suspension or stable dispersion with surfactants and water. This makes it practically impossible to use such form of zinc stearate because the dispersion has no shelf life, and if used to coat toner particles after settling, it will create unacceptable inconsistencies in the coated toner obtained. Furthermore, it is not feasible to coat a 3 to 4 microns size non-pigmented resin particle with a dispersion consisting of primary particles in the range of 20 to 50 microns size such as zinc stearate.

One method in use to obtain stable zinc stearate particle dispersions is a homogenization method. See, for example, U.S. Pat. No. 6,340,549 describing the use of a homogenizer in making a dispersion of a toner additive that may be zinc stearate (see column 7, lines 38–50 and column 8, lines 1–18. In this method, a stable zinc stearate dispersion is prepared in a sealed reactor by melting zinc stearate in water containing a surfactant, for example at about 140° C., and then homogenizing the solution at a pressure in excess of 4,000 psi using a high pressure piston homogenizer. The high-temperature, high-shear homogenization is required to breakdown the zinc stearate particles from a micron size to the necessary nanometer size so that the dispersion becomes stable.

However, there are major challenges associated with this homogenization process. First, the commercial high-pressure homogenizer (e.g., a Gaulin homogenizer) together with the high-pressure reactor system is very expensive. Second, the high temperature (>140° C.) and high pressure (>4,000 psi) process requirements, coupled with the inherently abrasive nature of the zinc stearate, wears down the equipment very quickly, causing unacceptable downtime and costly mechanical parts repair (e.g., of the compression chamber, plunger, valve seats, etc). Third, in the process, the molten nanometer sized particles must be quenched to a temperature below about 50° C. before discharge in order to prevent re-aggregation of the particles due to crystallization. Fourth, the process time to make the zinc stearate dispersion is very lengthy, for example on the order of 6 to 8 hours. In addition, additional time is required to frequently clean and maintain the equipment as mentioned above.

U.S. Pat. No. 6,162,836 describes a process for preparing an aqueous dispersion of a higher fatty acid zinc salt which comprises adding a molten higher fatty acid to an aqueous dispersion of zinc oxide and reacting the higher fatty acid with the zinc oxide in the presence of a surfactant or a water-soluble polyvinyl alcohol with stirring while the aqueous dispersion is maintained at a temperature that is higher than the melting point of the higher fatty acid used. This patent thus reacts a zinc oxide with a higher fatty acid, including stearic acid, to obtain a zinc salt dispersion, including zinc stearate. However, the dispersion is obtained through the use of an acid and with a required use of high temperature (above the melting point of the higher fatty acid). The use of salts (e.g., stearates) instead of a higher fatty acid is not taught or suggested, nor is the use of lower process temperatures. Further, the examples indicate that the process achieves large zinc stearate particles, for example on the order of larger than 1 $\mu$m.

U.S. Pat. No. 4,410,446 describes stable, fluid zinc-containing dispersions and the preparations thereof by the high temperature decomposition of zinc acetate to ZnO in a dispersant-containing fluid, the dispersant being stable at the temperature of decomposition.

U.S. Pat. No. 5,998,523 discloses a composition of an essentially solid phase state having as components a liquid hydrophilic organic polymer, an aqueous salt solution containing at least one metallic or metalloid element, and a coagulating agent. The composition on calcination provides a metal-containing powder having an average particle size of 1 $\mu$m or less. Such metal-containing powders are described to be of value in the preparation of industrial catalysts, ceramics, electronic components, or as fillers in plastics, paints or cosmetics.

U.S. Pat. No. 5,939,079 describes a process for the dispersion of at least one pulverulent organic filler and/or of at least one pulverulent inorganic filler in a vehicle composed of at least one fatty phase, by mixing the filler or fillers in the vehicle by high-pressure homogenization in one or a number of passes, and describes cosmetic or dermatological compositions capable of being obtained by the process. The use of the compositions obtained as the basis for care, make-up and/or hygiene products is indicated, the compositions providing protection against the effects of ultraviolet radiation.

It is an object of the invention to develop an improved method of making a stable zinc stearate particle aqueous dispersion.

SUMMARY OF THE INVENTION

These and other objects are achieved by the present invention, which in embodiments relates to a method of forming an aqueous dispersion of particles of zinc stearate, the method comprising forming a mixture of at least one surfactant and water, heating the mixture to a temperature of from about 40° C. to less than a melting temperature of zinc stearate, adding a metal-containing stearate to the mixture under agitation, adding to the mixture a solution comprised of a zinc salt in water, whereby upon inclusion of both the metal-containing stearate and the zinc salt in the mixture, the zinc salt reacts with the metal-containing stearate to form the particles of zinc stearate, continuing the heating and agitation following completion of the latter of the adding of the solution of zinc salt or the adding of the metal-containing stearate to continue the reaction, and cooling to obtain the aqueous dispersion comprised of particles of zinc stearate.

The method of the invention achieves an aqueous dispersion of zinc stearate that is stable, and is preferably comprised of zinc stearate particles having a size of less than 1 micron, preferably less than about 900 nm.

In embodiments, the invention also relates to a method of forming toner particles coated with zinc stearate particles, the method comprising forming a mixture of at least one surfactant and water, heating the mixture to a temperature of from about 40° C. to less than a melting temperature of zinc stearate, adding a metal-containing stearate to the mixture under agitation, adding to the mixture a solution comprised of a zinc salt in water, whereby upon inclusion of both the metal-containing stearate and the zinc salt in the mixture, the zinc salt reacts with the metal-containing stearate to form the particles of zinc stearate, continuing the heating and agitation following completion of the latter of the adding of the solution of zinc salt or the adding of the metal-containing stearate to continue the reaction, cooling to obtain an aqueous dispersion comprised of particles of zinc stearate,mixing the aqueous dispersion of zinc stearate particles with toner particles to coat the toner particles with the zinc stearate particles, and recovering, washing and drying the toner particles coated with the zinc stearate particles.

The method thus finds particular utility in coating toner particles, particularly emulsion aggregation toner particles, with zinc stearate particles. Such coated toner particles may be colorant free and find utility as a cleaning additive in a developer composition containing additional, colorant-containing toner particles.

DETAILED DESCRIPTION OF PREFERRED EMBODIMENTS

The method of the present invention is able to obtain stable aqueous dispersions of zinc stearate particles. By "stable" as used herein is meant that the dispersion exhibits substantially no sedimentation of solids for at least two weeks. The dispersion thus is able to be prepared and stored for short periods of time such as, for example, two to four weeks, and subsequently used without fear of failure of the dispersion.

A first embodiment of the invention relates to a method of forming an aqueous dispersion comprised of particles of zinc stearate, the method comprising forming a mixture of at least one surfactant and water, heating the mixture to a temperature of from about 40° C. to less than a melting temperature of zinc stearate, adding a metal-containing stearate to the mixture under agitation, following the adding of the metal-containing stearate to the mixture, subsequently adding to the mixture a solution comprised of a zinc salt in water, whereby the zinc salt reacts with the metal-containing stearate to form the particles of zinc stearate, continuing the heating and agitation following completion of the adding of the solution of zinc salt to continue the reaction, and cooling the materials to obtain the aqueous dispersion comprised of particles of zinc stearate.

In forming the mixture of surfactant and water, it is most preferable to use deionized water. As the surfactant, there is no particular limitation, and any suitable surfactant or surfactant mixture may be used.

Any other suitable components and/or additives may be included in the mixture as desired, i.e., the mixture is not limited to including only initially surfactant(s) and water. This would include the fact that either the metal-containing stearate or the zinc salt may also be added to the initial mixture.

The surfactant may be any of, for example, an anionic, ionic or nonionic surfactant, or mixtures thereof. An effective concentration of the surfactant(s) generally employed is, for example, from about 0.01 to about 10 percent by weight, and preferably from about 0.1 to about 5 percent by weight, of the mixture.

Examples of anionic surfactants include, for example, sodium dodecylsulfate (SDS), sodium dodecylbenzene sulfonate, sodium dodecylnaphthalenesulfate, dialkyl benzenealkyl, sulfates and sulfonates, abitic acid, available from Aldrich, NEOGEN RK and NEOGEN SC from Kao and the like. Examples of nonionic surfactants include, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol available from Rhodia as IGEPAL CA-210, IGEPALCA CA-520, IGEPALCA CA-720, IGEPALCO CO-890, IGEPALCO CO-720, IGEPAL CO-290, IGEPAL CA-210, ANTAROX 890 and ANTAROX 897.

One of the advantages of the present invention is that the higher temperatures required (i.e., temperatures above the melting point of zinc stearate) in a zinc stearate size reduction procedure such as the homogenization procedure discussed above may be avoided, thus permitting the derivation of a zinc stearate dispersion with less energy consumption and with less stress upon the equipment. In the process, the mixture of surfactant and water is preferably heated to a temperature of from about 40° C. to less than a melting temperature of zinc stearate. In size reduction processes for zinc stearate, the temperature needs to be above the melting point of the zinc stearate, i.e., above 130° C., preferably above about 140° C., in order for the size reduction of the zinc stearate to proceed. In the present invention, however, the mixture is preferably heated to a temperature of from about 40° C. to about 120° C., preferably about 50° C. to about 70° C. Such low temperature heating is desirable to assist in the solubility of the materials, in particular the metal-containing stearate, in the water, and thereby assist in the reaction of the materials in forming the zinc stearate particles.

In a preferred process of the invention, the metal-containing stearate is first introduced to the mixture and the zinc salt introduced thereafter. This preferred process is detailed below.

Before, during and/or after the heating of the surfactant and water mixture, a metal-containing stearate is introduced into the mixture. Agitation of the mixture is begun before, during and/or after addition of the metal-containing stearate.

The metal-containing stearate may be added all at once or metered into the mixture without limitation. Additional water may be added to the mixture after addition of the metal-containing salt to rinse additional metal-containing stearate that did not make it into the mixture upon addition, e.g., metal-containing stearate in and around the point of introduction and/or the sides of the apparatus used, into the mixture.

The amount of metal-containing stearate introduced may be, for example, about 20% by weight or less of the amount of water in the apparatus, preferably about 15% by weight or less. While higher amounts of the metal-containing stearate may be added, it may become difficult to obtain a stable dispersion of zinc stearate particles from the mixture unless additional excess amounts of water are added with the addition of the zinc salt to the mixture.

The agitation of the mixture may be provided by any suitable means using any suitable type of apparatus. Sonically induced agitation may even be used. However, it is preferred to use an apparatus including blades or impellers therein that can impart high-shear, high-speed mixing to the mixture. For example, the agitation may be conducted at an rpm of from about 1,000 rpm to about 10,000 rpm, preferably from about 2,000 rpm to about 5,000 rpm.

As the metal-containing stearate, any known metal-containing stearate other than zinc stearate may be used. Preferably, the metal-containing stearate is soluble in water at the lower temperatures discussed above. As examples of the metal of the metal-containing stearate, mention may be made of an alkali metal (e.g., lithium, cesium, sodium, potassium), an alkaline-earth metal (e.g., calcium, barium, strontium) or a rare-earth metal (e.g., any metal of the lanthanide series). Preferably, the metal is an alkali metal such as potassium, cesium or sodium, more preferably sodium. Thus, a most preferred stearate in the method is sodium stearate.

Preferably following completion of the addition of the metal-containing stearate to the mixture, and while the mixture is still under agitation, preferably high-shear, high-speed mixing conditions as discussed above, a solution of a zinc salt is introduced into the mixture. The zinc salt solution may be prepared by, for example, dissolving the zinc salt in water, preferably at room temperature. The zinc salt may include additional components and/or additives, if desired, for example including additional surfactants, etc. A concentration of the zinc salt in the solution is not particularly limited. For example, the concentration of zinc salt in the solution may be from about 1% to about 20% by weight, preferably from about 4% to about 12% by weight.

While the zinc salt solution may be added all at once into the mixture, it is preferable to meter the zinc salt solution into the mixture over a period of time. For example, the zinc salt solution may be fed into the mixture in a total addition time of from about 1 minute to about 30 minutes, preferably in a time of from about 10 minutes to about 20 minutes. The amount of zinc salt added may be stoichiometric to the amount of metal-containing stearate, although such is not necessary and more or less zinc salt may be added as desired.

By "zinc salt" as that term is used herein is meant any salt that includes zinc therein, with the exception of zinc stearate. Zinc oxide is not intended. Preferably, although not necessarily, the zinc salt is soluble in water in order to more readily facilitate the reaction with the metal-containing stearate in the aqueous environment. As examples of zinc salts suitable for use in the present invention, mention may be made of zinc salts of organic esters such as, for example, zinc acetate, zinc caprylate, zinc carbolate, zinc carboxylate, zinc formate, zinc lactate, zinc laurate, zinc linoleate, zinc malate, zinc naphthalate, zinc octoate, zinc oleate, zinc oxalate, zinc palmitate, zinc propionate, zinc salicylate, and the like, and inorganic type zinc salts such as, for example, zinc sulfate, zinc borate, zinc bromate, zinc chloride, zinc chromate, zinc nitrate, zinc permanganate, zinc thiocyanate, and the like. More preferably, the zinc salt is zinc acetate, zinc chloride or zinc sulfate. Most preferably in terms of low temperature solubility in water, the zinc salt is zinc acetate.

Agitation of the mixture is continued during the addition of the zinc salt solution. The agitation is preferably maintained at or increased from the agitation of the mixture prior to introduction of the zinc salt solution thereto. For example, the agitation upon addition of the zinc salt solution may be from about 1,000 rpm to about 15,000 rpm, preferably from about 3,000 rpm to about 10,000 rpm. The agitation need not be maintained at a constant during the addition of the zinc salt solution, but may be varied, for example increased, over the course of the addition.

The temperature of the mixture is preferably maintained during the addition of the zinc salt to the mixture.

Upon addition of the zinc salt solution to the mixture that includes the previously added metal-containing stearate, the zinc salt and metal-containing stearate react to form zinc stearate particles dispersed in the aqueous mixture. For example, using zinc acetate and sodium stearate as a preferred example, the reaction is shown as $$Zn(Ac)_2+2NaSt \rightarrow Zn(St)_2+2NaAc.$$

In addition to the zinc stearate, a metal-containing salt by-product is obtained. Preferably, the reactants are selected such that this salt by-product is soluble in water and thus remains in solution in the dispersion. Upon subsequent use of the zinc stearate dispersion to coat zinc stearate particles on toner particles as discussed more fully below, the by-product may be easily rinsed away from the coated toner particles during a washing procedure due to the by-products ready solubility in water. Thus, the presence of the by-product of the reaction in the dispersion is not problematic.

Once the zinc salt solution has all been added into the mixture, the heating and agitation is continued until a predetermined size of zinc stearate particles are obtained. The agitation and heating conditions are preferably each maintained within the parameters set forth above (e.g., 1,000–15,000 rpm, temperature of from about 40° C. to less than the melting temperature of zinc stearate). Preferably, the zinc stearate particles obtained have a size of less than 1 $\mu$m, more preferably a size of from about 900 nm or less, and most preferably a size of from about 500 nm to about 700 nm. Particles within the above-mentioned ranges may be obtained by continuing the heating and agitation for a period of from, for example, about 1 minute to about 60 minutes, more preferably from about 1 minute to about 10 minutes.

The mixture is then cooled to a temperature of less than about 30° C., i.e., to about room temperature. The cooling step may be conducted through normal air cooling, for example by removing the heat source and/or by removing the mixture from the apparatus, or it may be conducted through any assisted cooling method known in the art. Preferably, cooling is achieved in about 1 minute to about 30 minutes, more preferably in about 1 minute to about 10 minutes.

Once cooled, the aqueous dispersion of zinc stearate particles is obtained. The dispersion preferably includes up to about 20% by weight of the zinc stearate particles. Most preferably for obtaining a stable zinc stearate dispersion, the dispersion contains 12% by weight or less of the zinc stearate particles.

While the process of the invention has been exemplified above by a process in which the zinc salt is added into a mixture including the metal-containing stearate, the process may also be conducted oppositely. That is, the process may also be practiced by introducing a metal-containing stearate solution/dispersion into a mixture that already includes the zinc salt therein.

Another advantage of the invention lies in the fact that it can prepare a stable aqueous dispersion of zinc stearate particles in a very short amount of time, for example in an amount of time of from about 2 hours or less, preferably from about 1 hour or less. This is particularly short compared to the particle size-reduction method (homogenization) processing time of from 6 to 8 hours.

Upon obtaining the dispersion of zinc stearate, the dispersion may then be used to coat toner particles, i.e., to provide the toner particles with an external additive coating of zinc stearate. Thus, in a further embodiment of the invention, the zinc stearate dispersion is mixed with toner particles to coat the toner particles with the zinc stearate particles. Such may be done in any suitable fashion without limitation. For example, the non-pigmented toner particles may be prepared in a water slurry to obtain an about 16% solids solution. Into the slurry, a calculated amount of zinc stearate dispersion of from about 1% to about 20%, preferably about 10%, by weight to toner ratio is added under continuous mixing at room temperature. The pH of the entire solution may then be adjusted, for example to about pH 5.8, using any suitable diluted mineral acid, e.g., 0.3M nitric acid. An optional flocculent such as 10% polyaluminum chloride solution may be added, if desired, following which the pH of the slurry should again be adjusted, e.g., to about pH 4.4 using a mineral acid. A suitable time of mixing should be permitted, for example about half an hour. The slurry should then be filtered to obtain the zinc stearate treated toner particles.

As the toner particles, any suitable toner known in the art may be used without limitation. Preferably, the toner is an emulsion aggregation toner, i.e., a polyacrylate or polyester based toner prepared by the known emulsion aggregation process. See, for example, U.S. Pat. Nos. 5,977,210, 5,370,963, 6,210,853, 6,120,967, each incorporated herein by reference, and the like. Emulsion aggregation toner particles are particularly susceptible to damage if contacted with organic solvents, and thus the use of an aqueous dispersion to coat the external additives on such toner is desirable. Such toner particles may have a size of from, for example, about 3 to about 10 $\mu$m, preferably about 3 to about 8 $\mu$m.

In a particularly preferred embodiment of the invention, the toner particles coated with the zinc stearate particles are non-colorant containing white toner particles. Such toner particles include the resin binder of the toner, but no colorant, and thus are white in color. These toner particles, when coated with the zinc stearate, find particular utility as a cleaning additive to a developer composition comprised of additional, colorant-containing toner particles, optionally with carrier particles. The presence of such white toner particles in the developer composition, for example in an amount of from about 10% by weight of the toner or less, assists in the inhibition of the build-up of dirt on the surface of a photoreceptor.

Following the coating of the toner particles with the zinc stearate particles, the coated toner particles may be recovered from the water by any suitable method, including, for example, filtering. The recovered coated toner particles are then washed, preferably with water. The washing removes residues from the toner particles, including the by-products of the zinc stearate formation reaction as discussed above. The washed toner particles are then dried, and thus ready for inclusion into a developer composition.

The invention will be further exemplified by way of the following example and comparative example.

EXAMPLE

This Example prepares a zinc stearate dispersion by a preferred process of the present invention. 24.3 g zinc acetate is dissolved in 252 g deionized water at room temperature. Separately, a diluted surfactant solution (8.62 g NEOGEN SC in 1,000 g deionized water) is then heated to 60° C. Into the heated surfactant solution, 77.7 g of the sodium stearate is added at once under high-shear, high-speed mixing at around 4,000 rpm. This is followed by adding the zinc acetate solution over approximately 10 minutes. Mixing at 60° C. is continued for 3 minutes at 8,000 rpm. Then, the content is cooled down to less than 30° C. in about 5–10 minutes. Total process is about 1 hour.

Comparative Example

The zinc stearate used is a zinc salt of commercial stearic acid with a melting point of about 140° C. The zinc stearate emulsification process is carried out at a temperature of 140° C. so that the zinc stearate particles become molten and hence breakable. A surfactant, NEOGEN SC, which contains about 65% of sodium dodecylbenzene sulfonate in water, is added to stabilize the zinc stearate particles.

A suspension consisting of 0.259 kg of NEOGEN SC paste and 14 kg of deionized water is prepared in a 5 gallon plastic pail equipped with a stirrer. 4.2 kg of zinc stearate and 0.21 kg of sodium stearate powders are added slowly to the pail to avoid dust cloud formation. The mixture is mixed gently for homogeneous pre-dispersion. It is preferred to prepare this mixture well in advance of the homogenization procedure in order to reduce foaming.

A 30-gallon reactor (a stainless steel reactor system piped in to feed the slurry to a Gaulin homogenizer at 140° C. or when the zinc stearate is in a molten stage) is then charged with the slurry. Finally, the reactor charge port is rinsed with 41.33 kg of deionized water to ensure all the materials get into the reactor. The agitator speed is increased to 100 rpm. With the bottom valve closed, the reactor is then heated to 140° C. to melt the zinc stearate. The hot water supply to the homogenizer and circulation line is also turned on to keep the circulation line and homogenizer at 140° C. With the homogenizer valves wide open, the bottom valve is opened and the homogenizer is turned on to circulate the suspension. After a steady temperature of 140° C. is reached, the secondary valve is set at 850 psi to start the pre-emulsification. After 2 hours of pre-emulsification, the primary valve is set at 8,000 psi while keeping the secondary valve at 850 psi. The emulsification takes another 2 hours under these settings.

Upon completion of emulsification, the emulsion is cooled rapidly to approximately 40° C., the temperature at which it will be discharged. The homogenizer is then shut down and the zinc stearate dispersion is drained from the system through a small ball valve located on the feed pipe to the homogenizer. Total process time is 6–8 hours.

The dispersion of the Example and the dispersion of the Comparative Example are evaluated for several properties.

Also, each dispersion is used in synthesizing a toner cleaning additive (including a non-pigmented emulsion aggregation white resin particle having a size of from about 3 to 4 microns), and properties are again evaluated.

| | | | Dispersion to Make Toner Cleaning Additive | | | |
|---|---|---|---|---|---|---|
| | ZnSt Dispersion Particle Size | Dispersion Stability | Toner Particle Size | Geometric Size Distribution (volumetric) (GSDv) | Geometric Size Distribution (number) (GSDn) | Remarks |
| Comparative Example | 587 nm | Good Stability | 3.9 microns | 1.35 | 1.35 | Good cleaning additive |
| Example | 548 nm | Good Stability | 3.6 microns | 1.28 | 1.31 | Good cleaning additive |

GSDv and GSDn are measured through the use of any suitable Coulter Counter, in this case a Beckman Coulter Counter Multisizer. The toner particle sizes from the Example and Comparative Example are both within experimental error and within the specified 3 to 4 microns size range.

As seen from the results in the table, the in-situ process of the present invention achieves a zinc stearate dispersion comparable in quality to a zinc stearate dispersion prepared by the size-reducing homogenization method, but in much less time and with a procedure far less strenuous on the equipment used, and thus overall much more efficient and cost effective.

What is claimed is:

1. A method of forming an aqueous dispersion comprised of particles of zinc stearate, the method comprising forming a mixture of at least one surfactant and water, heating the mixture to a temperature of from about 40° C. to less than a melting temperature of zinc stearate, adding a metal-containing stearate to the mixture under agitation, adding to the mixture a solution comprised of a zinc salt in water, whereby upon inclusion of both the metal-containing stearate and the zinc salt in the mixture, the zinc salt reacts with the metal-containing stearate to form the particles of zinc stearate, continuing the heating and agitation following completion of the latter of the adding of the solution of zinc salt or the adding of the metal-containing stearate to continue the reaction, and cooling to obtain the aqueous dispersion comprised of particles of zinc stearate, wherein the zinc stearate particles have a size of about 900 nm or less.

2. The method according to claim 1, wherein the adding of the solution of a zinc salt in water is by feeding the solution into the mixture in a total addition time of from about 1 minute to about 60 minutes.

3. The method according to claim 1, wherein the at least one surfactant comprises one or more of an anionic, cationic or ionic surfactant.

4. The method according to claim 1, wherein the heating is to a temperature of from about 50° C. to about 70° C.

5. The method according to claim 1, wherein a metal of the metal-containing stearate comprises a metal of an alkali metal.

6. The method according to claim 1, wherein a metal of the metal-containing stearate is sodium.

7. The method according to claim 1, wherein the zinc salt is selected from the group consisting of zinc acetate, zinc sulfate and zinc chloride.

8. The method according to claim 1, wherein the zinc salt is zinc acetate.

9. The method according to claim 1, wherein the solution of the zinc salt is added to the mixture following completion of the adding of the metal-containing stearate to the mixture.

10. The method according to claim 1, wherein the heating and agitation is continued until a predetermined size of zinc stearate particles is obtained.

11. The method according to claim 1, wherein the heating and agitation is continued for a period of from about 1 minute to about 30 minutes.

12. The method according to claim 1, wherein the zinc stearate particles have a size of from about 500 nm to about 700 nm.

13. The method according to claim 1, wherein the aqueous dispersion of zinc stearate particles is stable, without any substantial solids sedimentation, for at least two weeks.

14. The method according to claim 1, wherein the aqueous dispersion of zinc stearate particles comprises about 20% by weight or less of zinc stearate particles.

15. The method according to claim 1, wherein the process further comprises mixing the aqueous dispersion of zinc stearate particles with toner particles to coat the toner particles with the zinc stearate particles.

16. The method according to claim 15, wherein the process further comprises recovering, washing and drying the toner particles coated with the zinc stearate particles.

17. The method according to claim 15, wherein the toner particles comprise emulsion aggregation toner particles free of colorant.

18. The method according to claims 17, wherein the emulsion aggregation toner particles coated with zinc stearate particles are included in a developer composition as an additive in an amount of less than about 10% by weight of a total amount of toner in the developer composition.

19. A method of forming toner particles coated with zinc stearate particles, the method comprising forming a mixture of at least one surfactant and water, heating the mixture to a temperature of from about 40° C. to less than a melting temperature of zinc stearate, adding a metal-containing stearate to the mixture under agitation, adding to the mixture a solution comprised of a zinc salt in water, whereby upon inclusion of both the metal-containing stearate and the zinc salt in the mixture, the zinc salt reacts with the metal-containing stearate to form the particles of zinc stearate, continuing the heating and agitation following completion of the latter of the adding of the solution of zinc salt or the adding of the metal-containing stearate to continue the reaction, and cooling to obtain an aqueous dispersion comprised of particles of zinc stearate, mixing the aqueous dispersion of zinc stearate particles with toner particles to coat the toner particles with the zinc stearate particles, and recovering, washing and drying the toner particles coated with the zinc stearate particles, wherein the zinc stearate particles have a size of about 900 nm or less.

* * * * *